US005346174A

United States Patent [19]

Harwath

[11] Patent Number: 5,346,174

[45] Date of Patent: Sep. 13, 1994

[54] SPRING-BIASED VALVE ASSEMBLY FOR A GEAR PUMP

[75] Inventor: Frank L. Harwath, Rockford, Ill.

[73] Assignee: Suntec Industries Incorporated, Rockford, Ill.

[21] Appl. No.: 185,032

[22] Filed: Jan. 24, 1994

[51] Int. Cl.[5] ..... F16K 31/126
[52] U.S. Cl. ..... 251/61.3; 251/337
[58] Field of Search ..... 251/337, 61.2, 61.3

[56] References Cited

U.S. PATENT DOCUMENTS 1,524,217 1/1925 Small ..... 251/61.3 X
3,456,684 7/1969 Söchting ..... 251/337 X

OTHER PUBLICATIONS

Suntec Industries Incorporated Drawing No. 3773231, dated Apr. 21, 1992.

*Primary Examiner*—Arnold Rosenthal
*Attorney, Agent, or Firm*—Leydig, Voit & Mayer

[57] ABSTRACT

A gear pump includes a valve member adapted to engage a valve seat and close a control port and urged to an open position by a coil spring. In order to reduce cocking of the valve member relative to the valve seat when the valve member is closed, the end coil of the spring that engages the valve member is formed so as to be in non-parallel relation with the sealing surface of the valve seat when the spring is relaxed. As the spring is compressed during closure of the valve member, the end coil moves into parallelism with the sealing surface in order to enable the valve member to squarely engage the sealing surface.

3 Claims, 2 Drawing Sheets

SPRING-BIASED VALVE ASSEMBLY FOR A GEAR PUMP

BACKGROUND OF THE INVENTION

This invention relates to a valve assembly. While the valve assembly lends itself to various applications, it is particularly useful in connection with a gear pump of the type disclosed in Swedberg U.S. Pat. No. 3,556,901. The gear pump of the Swedberg patent is especially designed to supply fuel to an oil burner.

A pump of the type disclosed in the Swedberg patent includes a diaphragm-operated valve assembly which controls opening and closing of the main regulating valve for controlling the supply of fuel from the pump to the oil burner. Such a valve assembly includes a valve member adapted to open and close a control port. A spring engages one side of the valve member and urges the latter to an open position with respect to the control port. The other side of the valve member engages a flexible diaphragm which is responsive to the output pressure of the pump. When that pressure exceeds a predetermined magnitude, the diaphragm causes the valve member to close the control port against the bias of the spring and effect opening of the main regulating valve. When the pump is shut down, the spring snaps the valve member to a position opening the control port and effecting rapid closure of the regulating valve.

The valve assembly of the Swedberg patent utilizes a Belleville spring to urge the valve member to an open position with respect to the control port. In other valve assemblies, a conical coil spring is used to urge the valve member to its open position (see, for example, Harwath U.S. Pat. No. 5,145,328). Such a spring incorporates multiple coils which are compressed when the valve member is forced to its closed position against the valve seat by the pressure exerted on the flexible diaphragm. In conventional coil springs which have been used previously, the two end coils of the spring are disposed in substantially parallel planes and extend substantially perpendicular to the longitudinal axis of the spring. It has been found that, when the spring is compressed, the coils cause the valve member to assume a cocked position with respect to the valve seat. As a result, the control port may not be completely sealed by the valve member, and such incomplete sealing creates leakage through the port and reduces the efficiency of the pump.

SUMMARY OF THE INVENTION

The general aim of the present invention is to provide a valve assembly of the foregoing type having a new and improved coil spring whose coils are uniquely configured to enable the valve member to close squarely against the valve seat and completely seal the control port when the spring is compressed.

A more detailed object of the invention is to achieve the foregoing by providing a spring having an end coil which engages the valve member and which is cocked relative to the axis of the spring when the spring is relaxed. As the spring is compressed, the initially cocked end coil moves to a position extending substantially perpendicular to the axis of the spring and permits the valve member to close squarely against the valve seat.

These and other objects and advantages of the invention will become more apparent from the following detailed description when taken in conjunction with the accompanying drawings.

Figure 1:
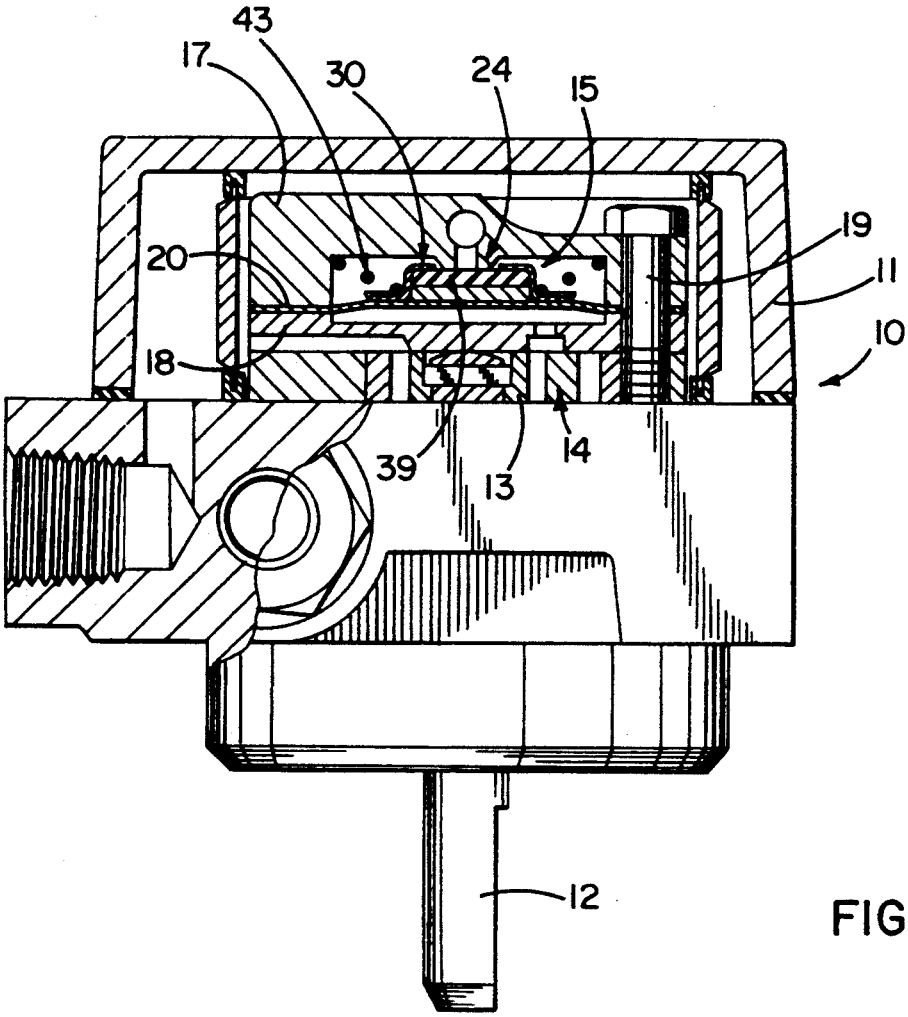
FIG. 1 is a side elevational view of a typical gear pump equipped with a new and improved valve assembly incorporating the unique features of the present invention, certain parts of the pump being broken away and shown in section.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

For purposes of illustration, the invention has been shown in the drawings as being embodied in a pump 10 and specifically in a gear pump for supplying fuel to an oil burner. The physical construction and the hydraulic circuitry of the pump are generally the same as disclosed in Swedberg U.S. Pat. No. 3,566,901.

The pump 10 as such does not form part of the present invention and shall be described only briefly. In general, the pump includes a housing 11 which rotatably supports a power driven shaft 12. The shaft serves to rotate the spur gear 13 of a gear set 14. When the spur gear is rotated, fuel oil is drawn from a tank, is pressurized, and is supplied to an oil burner. The supply of fuel to the burner is controlled by a main regulating valve (not shown) which opens automatically when the pump output pressure exceeds a predetermined value and closes when the output pressure falls below that value.

Opening and closing of the regulator valve is controlled by a diaphragm-operated valve assembly 15 which is located in the housing 11. More specifically, the valve assembly is located in a chamber 16 defined between two body or housing members 17 and 18 which are secured together by screws 19. A flexible diaphragm 20 is clamped between the housing members 17 and 18 and divides the chamber into upper and lower compartments 21 and 22.

The lower compartment 22 receives fuel at substantially the same pressure as the output of the gear set 14, such fuel being supplied to the lower compartment via a passage 23 in the housing member 18. Formed integrally with the upper housing member 17 and projecting into the upper compartment 21 is a valve seat 24 having a control port 25 which communicates with the upper compartment. When the port 25 is closed, pressurized fuel from the gear set 14 is utilized to open the main regulating valve and enable fuel to flow to the oil burner. Upon opening of the port, pressurized fuel from the gear set is returned directly to the tank and bypasses the regulator valve so as to enable the latter to close. The aforementioned Swedberg patent contains a more detailed disclosure of the operation of a valve assembly of the same general type as the present valve assembly 15.

To close the port 25, the valve assembly 15 includes a valve member 30 adapted to be shifted upwardly and downwardly in the chamber 16. Herein, the valve member includes a housing made of sheet metal and having a substantially planar top wall 32 with an axially extending hole 33 formed therethrough. The housing is generally circular in cross-section and includes an annular skirt 34 which is formed integrally with and depends from the outer periphery of the top wall 32.

Formed integrally with and depending from the lower margin of the skirt 34 is a radially projecting flange 35. The lower face of the flange is substantially flat and planar.

Telescoped into the valve member housing is a valve disc 39 made of a suitable elastomeric material. The disc is circular and its flat upper side abuts the lower side of the top wall 32. When the valve member 30 is closed, the upper side of the central portion of the disc 39 engages a flat and planar sealing surface 40 defined on the lower end of the valve seat 24, the latter projecting into the hole 33 in the top wall 32. Engagement of the upper side of the disc 39 with the sealing surface 40 closes off the control port 25.

The valve member 30 is completed by a retainer 41 in the form of a circular plate made of sheet metal. The retainer plate 41 is telescoped tightly into the housing and its lower face is disposed in the same plane as the lower face of the flange 35.

The flat lower faces of the flange 35 and the retainer plate 41 engage the upper side of the diaphragm 20. A coil spring 43 is located in the upper compartment 21 and bears downwardly on the flange 35 so as to bias the valve member 30 to its open position with respect to the port 25. When pressurized fuel is admitted into the lower compartment 22, the valve member 30 is moved closed against the bias of the spring 43.

According to the present invention, the spring 43 is uniquely constructed to keep the valve member 30 precisely square to the sealing surface 40 of the valve seat 24 and to avoid cocking of the valve member when the spring is compressed and the valve member is in its closed position. As a result, the upper side of the valve disc 39 seats intimately against the sealing surface 40 to prevent any leakage through the control port 25 and thereby increase the efficiency of the pump 10.

Figure 2:
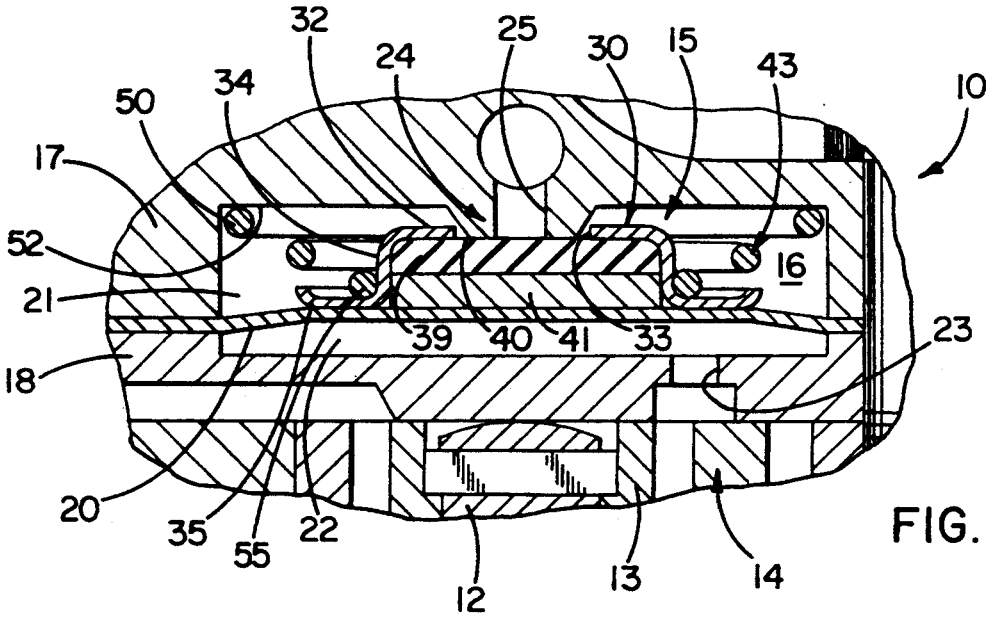
FIG. 2 is an enlarged view of certain components shown in FIG. 1.

More specifically, the spring 43 preferably is conical and decreases in diameter upon progressing downwardly. The upper end of the spring is defined by an end coil 50 which is conventionally formed so as to lie in a plane extending substantially perpendicular to the longitudinal axis A (FIG. 5) of the spring. As shown most clearly in FIG. 2, the upper end coil 50 bears against the upper wall 52 of the upper compartment 22 of the chamber 16.

Figure 3:
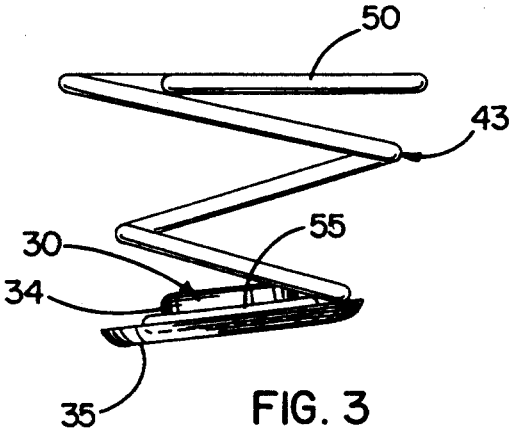
FIGS. 3 and 4 are elevational views of the spring and the valve member and show the spring in relaxed and compressed states, respectively.
Figure 5:
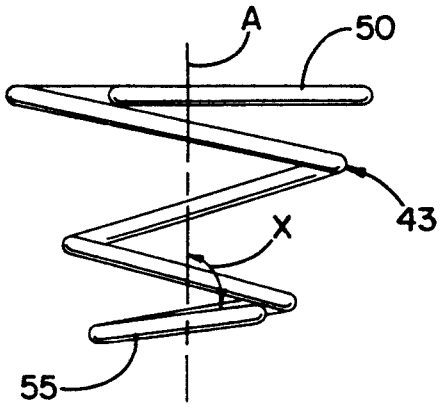
FIGS. 5 and 6 are elevational views of the spring itself and show the spring in relaxed and compressed states, respectively.

The lower end of the spring 43 is defined by an end coil 55 which loosely encircles the skirt 34 of the valve member 30 and bears against the upper side of the flange 35. In carrying out the invention, the spring 43 is formed such that, when the spring is in a fully relaxed state as shown in FIGS. 3 and 5, the lower end coil 55 lies in a plane which is inclined at an acute angle X (e.g., 84 degrees) relative to the axis A of the spring. Accordingly, the end coil 55—rather than being conventionally formed so as to be parallel to the end coil 50 when the spring is in a relaxed state—is formed so as to be in non-parallel relation with the end coil 50 when the spring is relaxed. As a result, the valve member 30 is cocked relative to the axis of the relaxed spring as shown in FIG. 3.

Figure 4:
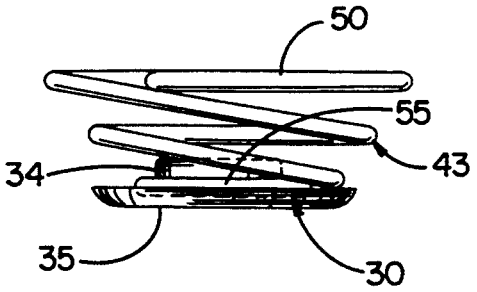
Figure 6:
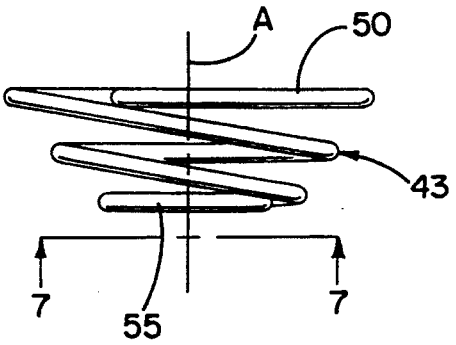
Figure 7:
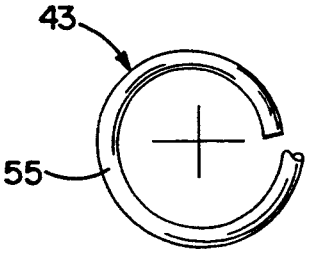
FIG. 7 is a fragmentary plan view of one end coil of the spring as seen substantially along the line 7—7 of FIG. 6.

When the spring 43 is compressed, however, during closure of the valve member 30, the end coil 55 moves into parallelism with the end coil 50 and the sealing surface 40 as the intermediate coils resiliently collapse. When the spring is fully compressed, the end coil 55 is disposed in a plane extending virtually perpendicular to the axis A of the spring (see FIG. 6) and thus the valve member 30 is permitted to assume a non-cocked position (FIG. 4) in which the upper side of the valve disc 39 is parallel to the sealing surface 40 of the valve seat 24. By virtue thereof, a better seal is established between the valve disc and the sealing surface than is otherwise the case where the lower end coil of the spring is initially parallel to the sealing surface when the spring is relaxed and assumes a cocked position as the spring is compressed. Better sealing of the port 24 increases the efficiency of the pump 10.

I claim:

1. A valve assembly comprising a body having a valve seat with a port therein, a valve member movable between open and closed positions with respect to said port, a coil spring located between said body and one side of said valve member and operable to urge said valve member toward said open position, a flexible diaphragm engageable with the opposite side of said valve member and operable to urge said valve member toward said closed position against the bias of said spring when said diaphragm is subjected to pressurized fluid, said spring having a longitudinal axis and having a first end coil located in engagement with said body, said spring having a relaxed state and a fully compressed state and being in said fully compressed state when said valve member is in said closed position, and said spring having a second end coil engageable with said one side of said valve member, said second end coil being disposed in a plane which is inclined at an acute angle relative to the axis of the spring when the spring is in said relaxed state and being disposed in a plane extending substantially perpendicular to said axis when said spring is in said fully compressed state thereby to enable said valve member to squarely engage said valve seat when said valve member is in said closed position.

2. A valve assembly comprising a body having a valve seat with a port therein, said valve seat having a substantially flat sealing surface disposed in a predetermined plane, a valve member disposed within said body and movable between open and closed positions with respect to said port along a path extending substantially perpendicular to the plane of said sealing surface, said valve member engaging said sealing surface when said valve member is in said closed position, a coil spring located between said body and one side of said valve member and operable to urge said valve member toward said open position, a flexible diaphragm engageable with the opposite side of said valve member and operable to urge said valve member toward said closed position against the bias of said spring, said spring having a first end coil disposed in engagement with said body and having a longitudinal axis extending substantially perpendicular to said sealing surface, said spring having a fully relaxed state and a fully compressed state and being in said fully compressed state when said valve member is in said closed position, and said spring having a second end coil engageable with said one side of said valve member and disposed in a plane which is inclined at an acute angle relative to the axis of the spring when the spring is in said fully relaxed state, said second end coil being disposed in a plane disposed substantially perpendicular to said axis and substantially parallel to the plane of said sealing surface when said spring is in said fully compressed state thereby to enable said valve member to squarely engage said sealing surface when said valve member is in said closed position.

3. A valve assembly as defined in claim 2 in which said second end coil is in non-parallel relation with said first end coil when said spring is in said fully relaxed state and is in more nearly parallel relation with said first end coil when said spring is in said fully compressed state.

* * * * *